US012110668B2

(12) United States Patent
Liu et al.

(10) Patent No.: US 12,110,668 B2
(45) Date of Patent: Oct. 8, 2024

(54) CUSTOMIZED WATER OUTLET SETTING METHOD AND CUSTOMIZED WATER OUTLET METHOD FOR QUANTITATIVE FAUCET AND QUANTITATIVE FAUCET

(71) Applicant: Zhangzhou Solex Smart Home Co., Ltd., Zhangzhou (CN)

(72) Inventors: Jun Liu, Zhangzhou (CN); Wei Lu, Zhangzhou (CN); Chuanliang Li, Zhangzhou (CN)

(73) Assignee: Zhangzhou Solex Smart Home Co., Ltd., Zhangzhou (CN)

( * ) Notice: Subject to any disclaimer, the term of this patent is extended or adjusted under 35 U.S.C. 154(b) by 135 days.

(21) Appl. No.: 17/959,372

(22) Filed: Oct. 4, 2022

(65) Prior Publication Data

US 2023/0131886 A1 Apr. 27, 2023

(30) Foreign Application Priority Data

Oct. 27, 2021 (CN) ..... 202111254909.6

(51) Int. Cl.
*E03C 1/05* (2006.01)

(52) U.S. Cl.
CPC ..... *E03C 1/055* (2013.01)

(58) Field of Classification Search
CPC ..... E03C 1/005
USPC ..... 4/626, 625, 619
See application file for complete search history.

(56) References Cited

U.S. PATENT DOCUMENTS 2,997,721 A * 8/1961 Hopfeld ..... B66F 11/04
134/191

FOREIGN PATENT DOCUMENTS

| | | | | | |
|---|---|---|---|---|---|
| CN | 106641366 | A | * | 5/2017 | ..... E03C 1/0404 |
| CN | 211059466 | U | * | 7/2020 | ..... A47J 31/00 |
| CN | 211338852 | U | * | 8/2020 | ..... A47J 31/00 |
| CN | 212177982 | U | * | 12/2020 | ..... A47J 31/00 |
| CN | 112220355 | A | * | 1/2021 | ..... A47J 31/00 |
| CN | 114326835 | A | * | 4/2022 | ..... G01F 25/10 |
| CN | 114355991 | A | * | 4/2022 | ..... E03C 1/055 |

* cited by examiner

*Primary Examiner* — Lori L Baker
(74) *Attorney, Agent, or Firm* — Cooper Legal Group, LLC

(57) ABSTRACT

A customized water outlet setting method, a customized water outlet method for a quantitative faucet, and a quantitative faucet are provided. The method comprises receiving a first touch/press signal of a water outlet setting switch, and entering a customized setting mode; receiving a quantitative gear position setting signal of a flow selection switch, and obtaining a corresponding quantitative gear position as a customized water outlet gear position; receiving a second touch/press signal of a water outlet control switch, controlling a water outlet valve to be opened, and controlling a flowmeter to start flow counting; after receiving the second touch/press signal of the water outlet control switch again, controlling the water outlet valve to be closed, and controlling the flowmeter to end the flow counting; setting a capacity obtained by the flowmeter as a water outlet capacity corresponding to the customized water outlet gear position; and exiting the customized setting mode.

14 Claims, 8 Drawing Sheets

(a)

(b)

(a)

(b)

(a)

(b)

(a)

(b)

(a)

(b)

CUSTOMIZED WATER OUTLET SETTING METHOD AND CUSTOMIZED WATER OUTLET METHOD FOR QUANTITATIVE FAUCET AND QUANTITATIVE FAUCET

RELATED APPLICATIONS

This application claims priority to Chinese patent application number 202111254909.6, filed on Oct. 27, 2021. Chinese patent application number 202111254909.6 is incorporated herein by reference.

FIELD OF THE DISCLOSURE

The present disclosure relates to the technical field of water outlet control, and in particular to a customized water outlet setting method and a customized water outlet method for a quantitative faucet and the quantitative faucet.

BACKGROUND OF THE DISCLOSURE

At present, a quantitative water outlet faucet exists in the market, and the quantitative water outlet faucet can discharge water with a predetermined quantity of water corresponding to a water outlet gear position set by a user. The quantitative water outlet faucet can be automatically closed when a quantity of water reaches a predetermined value, so that the user does not need to pay attention to the quantity of the water outlet at any time. However, the water outlet gear positions of the quantitative water outlet faucet on the market are all fixed, that is, the quantity of water corresponding to each water outlet gear position is fixed, such as 1 L, 2 L, 3 L, etc., and the number of the water outlet gear positions is also limited. However, at present, consumers pursue individuation, water consumption conditions of each family are different, and the gear position setting of the existing quantitative water outlet gear position cannot meet the individuation requirements of the consumers. For example, the quantity of water corresponding to the quantitative water outlet gear position of a certain quantitative water outlet faucet is 1 L, 2 L, 3 L, etc., and if the consumers need to discharge 1.5 L of water quantitatively, the quantitative water outlet faucet cannot meet the quantitative requirements of the consumers.

BRIEF SUMMARY OF THE DISCLOSURE

The present disclosure provides a customized water outlet setting method and a customized water outlet method for a quantitative faucet and the quantitative faucet, which can reset a water outlet capacity corresponding to a quantitative gear position and meet the personalized requirements of consumers In order to solve the technical problem, a first technical solution of the present disclosure is as follows.

A customized water outlet setting method for a quantitative faucet comprises: receiving a first touch/press signal of a water outlet setting switch, and entering a customized setting mode: receiving a quantitative gear position setting signal of a flow selection switch, and obtaining a corresponding quantitative gear position as a customized water outlet gear position: receiving a second touch/press signal of a water outlet control switch, controlling a water outlet valve to be opened, and controlling a flowmeter to start flow counting: after receiving the second touch/press signal of the water outlet control switch again, controlling the water outlet valve to be closed, and controlling the flowmeter to end the flow counting: setting a capacity obtained by the flowmeter as a water outlet capacity corresponding to the customized water outlet gear position; and exiting the customized setting mode.

Preferably, the water outlet setting switch and the water outlet control switch are independently arranged.

Preferably, the water outlet setting switch and the water outlet control switch are a same switch: before entering the customized setting mode, the customized water outlet setting method further comprises: judging a duration of receiving the first touch/press signal of the water outlet setting switch, and when the duration of receiving the first touch/press signal of the water outlet setting switch is greater than or equal to a first duration, entering the customized setting mode: before controlling the water outlet valve to be opened, the customized water outlet setting method further comprises: judging a duration of receiving the second touch/press signal of the water outlet control switch, and when the duration of receiving the second touch/press signal of the water outlet control switch is less than a second duration, controlling the water outlet valve to be opened: before controlling the water outlet valve to be closed, the customized water outlet setting method further comprises: judging the duration of receiving the second touch/press signal of the water outlet control switch for a second time, when the duration of receiving the second touch/press signal of the water outlet control switch for the second time is less than the second duration, controlling the water outlet valve to be closed; and the first duration is greater than or equal to the second duration.

Preferably, before setting a capacity obtained by the flowmeter as the water outlet capacity corresponding to the customized water outlet gear position, the customized water outlet setting method further comprises: receiving the first touch/press signal of the water outlet setting switch again.

Preferably, the water outlet setting switch and the water outlet control switch are a same switch; before entering the customized setting mode, the customized water outlet setting method further comprises: judging a duration of receiving the first touch/press signal of the water outlet setting switch, and when the duration of receiving the first touch/press signal of the water outlet setting switch is greater than or equal to a first duration, entering the customized setting mode: before controlling the water outlet valve to be opened, the customized water outlet setting method further comprises: judging a duration of receiving the second touch/press signal of the water outlet control switch, and when the duration of receiving the second touch/press signal of the water outlet control switch is less than a second duration, controlling the water outlet valve to be opened: before controlling the water outlet valve to be closed, the customized water outlet setting method further comprises: judging the duration of receiving the second touch/press signal of the water outlet control switch for a second time, and when the duration of receiving the second touch/press signal of the water outlet control switch for the second time is less than the second duration, controlling the water outlet valve to be closed; before exiting the customized setting mode, the customized water outlet setting method further comprises: judging the duration of receiving the first touch/press signal of the water outlet setting switch for a second time, and when the duration of receiving the first touch/press signal of the water outlet setting switch for the second time is greater than or equal to the first duration, exiting the customized setting mode; and the first duration is greater than or equal to the second duration.

Preferably, after receiving the first touch/press signal of the water outlet setting switch, the customized water outlet setting method further comprises: controlling a customized indicator lamp to display a first color: after receiving the quantitative gear position setting signal of the flow selection switch, the customized water outlet setting method further comprises: controlling the customized indicator lamp to display a second color; and after receiving the first touch/press signal of the water outlet setting switch again, the customized water outlet setting method further comprises: controlling the customized indicator lamp to display a third color.

Preferably, after receiving the first touch/press signal of the water outlet setting switch, the customized water outlet setting method further comprises: controlling a customized indicator lamp to display a first color: after receiving the quantitative gear position setting signal of the flow selection switch, the customized water outlet setting method further comprises: controlling the customized indicator lamp to display a second color; and after receiving the first touch/press signal of the water outlet setting switch again, the customized water outlet setting method further comprises: controlling the customized indicator lamp to display a third color.

Preferably, at least one of the first color, the second color, or the third color is different from the others of the first color, the second color, and the third color.

A customized water outlet method of the quantitative faucet, based on the customized water outlet setting method, comprises: receiving a quantitative water outlet gear position set by the flow selection switch, and judging whether the quantitative water outlet gear position is the customized water outlet gear position or not: when the quantitative water outlet gear position is the customized water outlet gear position, after receiving the second touch/press signal of the water outlet control switch, controlling the water outlet valve to be opened; and when the flowmeter senses that a water quantity flowing therethrough has reached the water outlet capacity corresponding to the customized water outlet gear position, controlling the water outlet valve to be closed.

A quantitative faucet comprises a water outlet setting switch, a water outlet control switch, a flow selection switch, and a program control module. The flow selection switch comprises a quantitative ring, and the quantitative ring comprises a plurality of quantitative water outlet gear positions. Each of the plurality of quantitative water outlet gear positions is correspondingly disposed with an induction magnet. The program control module comprises a water outlet valve, a flowmeter, and a control chip, and the induction magnet is magnetically connected with a hall sensor on the control chip. The control chip is connected with the water outlet setting switch to receive a first touch/press signal of the water outlet setting switch so as to enter a customized setting mode, so that one of the plurality of quantitative water outlet gear positions selected by the flow selection switch is configured to be set as a customized water outlet gear position and a water outlet capacity corresponding to the one of the plurality of quantitative water outlet gear positions is configured to be modified into a customized water outlet capacity. The water outlet control switch is connected with the control chip. After the flow selection switch is configured to select the customized water outlet gear position, the control chip is configured to control the water outlet valve to be opened after receiving a second touch/press signal of the water outlet control switch, so that when the flowmeter senses that a quantity of water flowing therethrough has reached the customized water outlet capacity corresponding to the customized water outlet gear position, the control chip is configured to control the water outlet valve to be closed.

Preferably, the water outlet setting switch and the water outlet control switch are independently arranged, or the water outlet setting switch and the water outlet control switch are a same switch.

Preferably, the water outlet setting switch and the water outlet control switch are touch sensitive switches or mechanical switches.

Preferably, the quantitative faucet comprises a faucet or a shower head.

Compared with the existing techniques, the technical solution has the following advantages.

(1) The present disclosure enters a customized setting mode by receiving the first touch/press signal of the water outlet setting switch, controls an opening and a closing of the water outlet valve by receiving the second touch/press signal of the water outlet control switch after the flow selection switch is rotated to one of the quantitative gear positions, and counts the capacity flowing from the water outlet valve being opened to being closed by the flowmeter. That is, the capacity corresponding to the one of the quantitative gear positions can be set as the water outlet capacity, thereby meeting the individual requirements of consumers.

(2) The water outlet setting switch and the water outlet control switch can be independently arranged, or the water outlet setting switch and the water outlet control switch can be the same switch. When the same switch is provided, whether the water outlet capacity is reset or the water outlet/water closing is controlled can be distinguished through the duration of touching/pressing the same switch.

(3) The customized water outlet setting method can quit the customized setting mode after receiving the second touch/press signal of the water outlet control switch again and controlling the water outlet valve to be closed, thereby simplifying the operation steps. In order to prevent the error resetting, when receiving the first touch/press signal of the water outlet setting switch again, exiting the customized setting mode.

(4) The present disclosure indicates a current mode through the customized indicator lamp, provides a visual prompt for consumers, prevents misoperation, and further improves the satisfaction degree of the consumers.

The above description is only an overview of the technical solutions of the present disclosure, and the embodiments of the present disclosure are described below in order to make the technical means of the present disclosure more clearly understood and to make the description of the technical means more comprehensible.

The above and other objects, advantages, and features of the present disclosure will become more apparent to those skilled in the art from the following detailed description of specific embodiments thereof, taken in conjunction with the accompanying drawings.

DETAILED DESCRIPTION OF THE EMBODIMENTS

The present disclosure will be further described below in combination with the accompanying drawings and embodiments.

Figure 1:
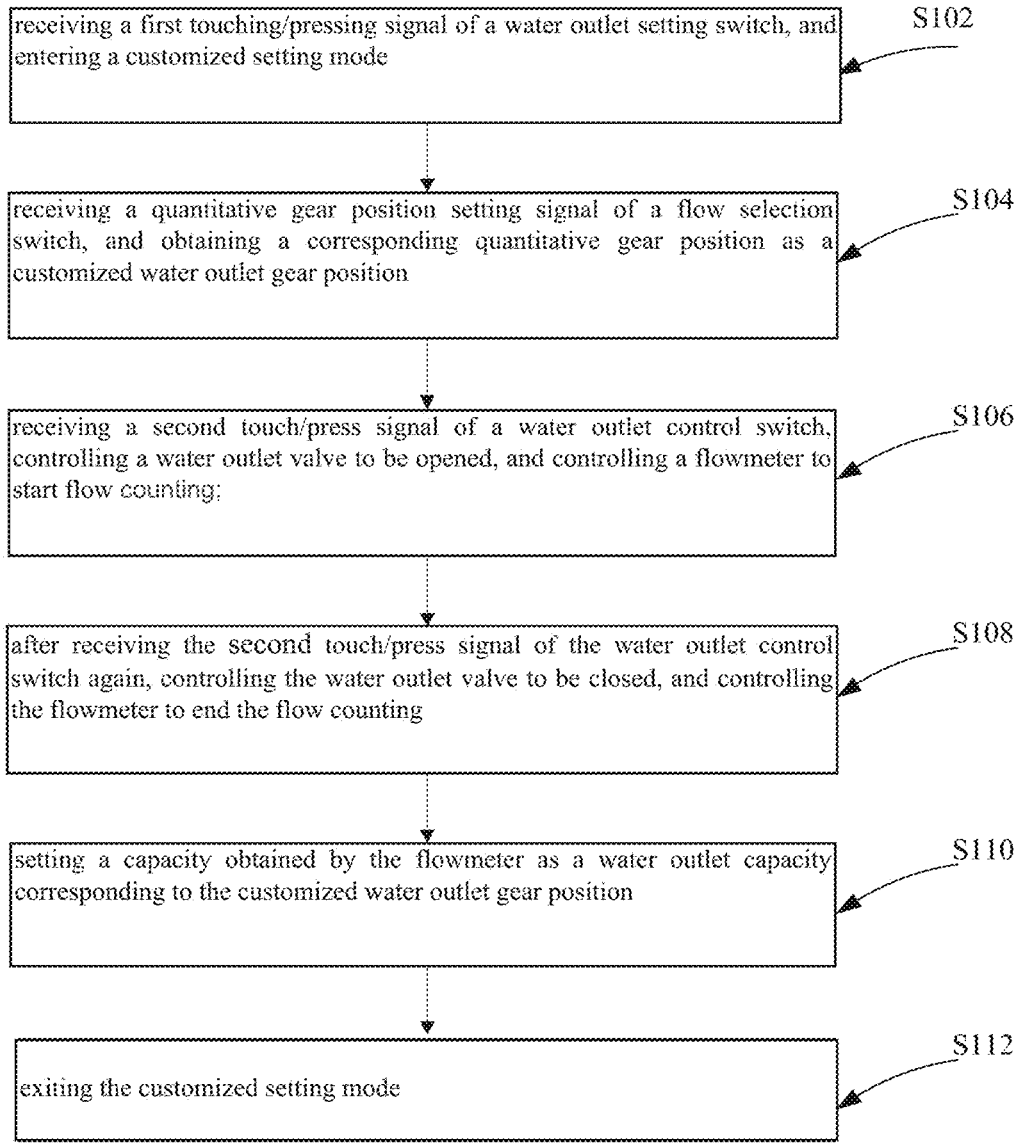
FIG. 1 illustrates a first flow chart of a customized water outlet setting method for a quantitative faucet of the present disclosure.

Referring to FIG. 1, a customized water outlet setting method for a quantitative faucet 10 of the present disclosure comprises:

S102: receiving a first touch/press signal of a water outlet setting switch, and entering a customized setting mode;

S104: receiving a quantitative gear position setting signal of a flow selection switch, and obtaining a corresponding quantitative gear position as a customized water outlet gear position;

S106: receiving a second touch/press signal of a water outlet control switch, controlling a water outlet valve to be opened, and controlling a flowmeter to start flow counting;

S108: after receiving the second touch/press signal of the water outlet control switch again, controlling the water outlet valve to be closed, and controlling the flowmeter to end the flow counting;

S110: setting a capacity obtained by the flowmeter as a water outlet capacity corresponding to the customized water outlet gear position; and S112: exiting the customized setting mode.

In the customized water outlet setting method for the quantitative faucet 10 of this embodiment, an execution subject can be a control chip of the quantitative faucet 10, and a processor is integrated on the control chip.

In this embodiment, the customized setting mode is entered by receiving the first touch/press signal of the water outlet setting switch. After the flow selection switch is rotated to correspond to one of a plurality of quantitative gear positions, the water outlet valve is controlled to be opened and closed by receiving the second touch/press signal of the water outlet control switch. The flowmeter is used for counting the capacity flowing through the water outlet valve during a period from the water outlet valve being opened to being closed, so that the capacity corresponding to the one of the plurality of quantitative gear positions can be set as the water outlet capacity, and an individualized requirement of a consumer is met.

Figure 2:
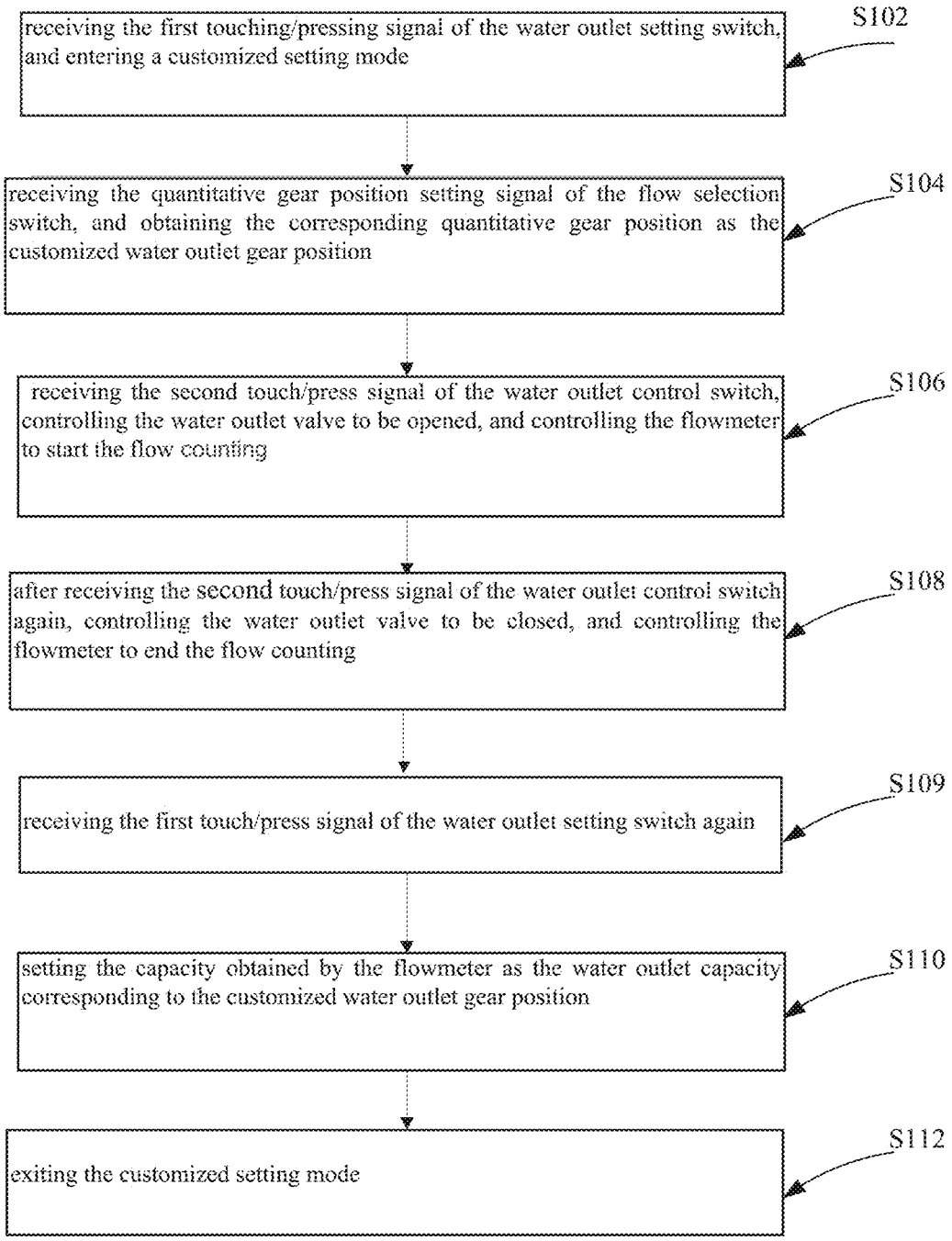
FIG. 2 illustrates a second flow chart of the customized water outlet setting method for a quantitative faucet of the present disclosure.
Figure 3:
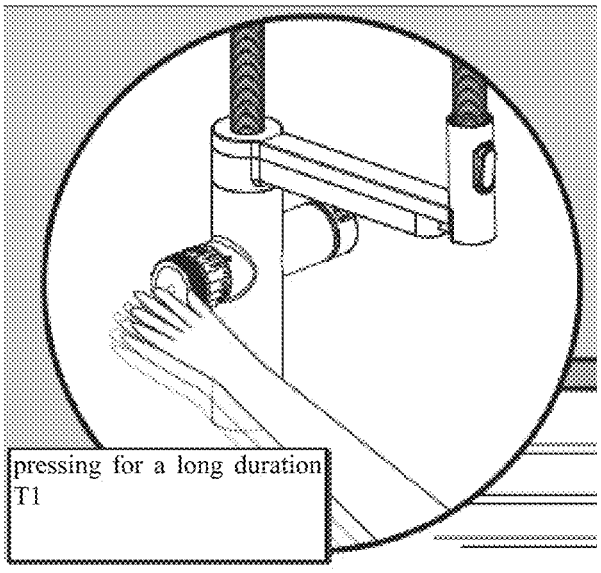
FIG. 3 illustrates a Step 1 of the customized water outlet setting method of the present disclosure, wherein (a) represents an operation step and (b) represents an operation result.
Figure 3:
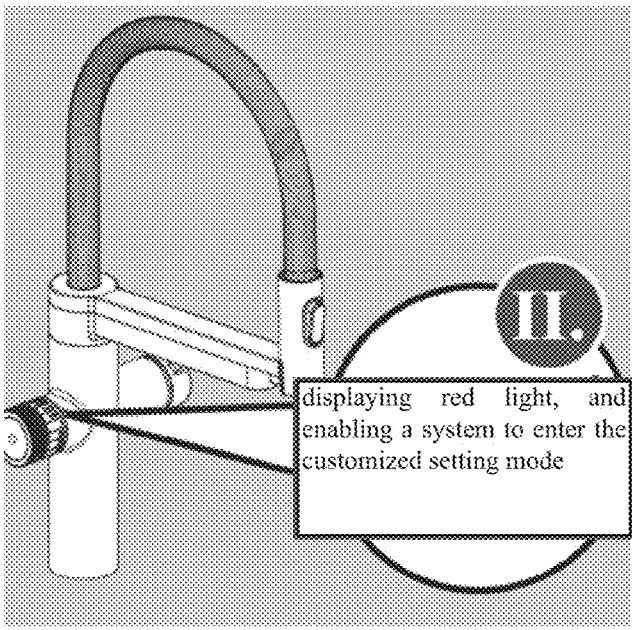
Figure 4:
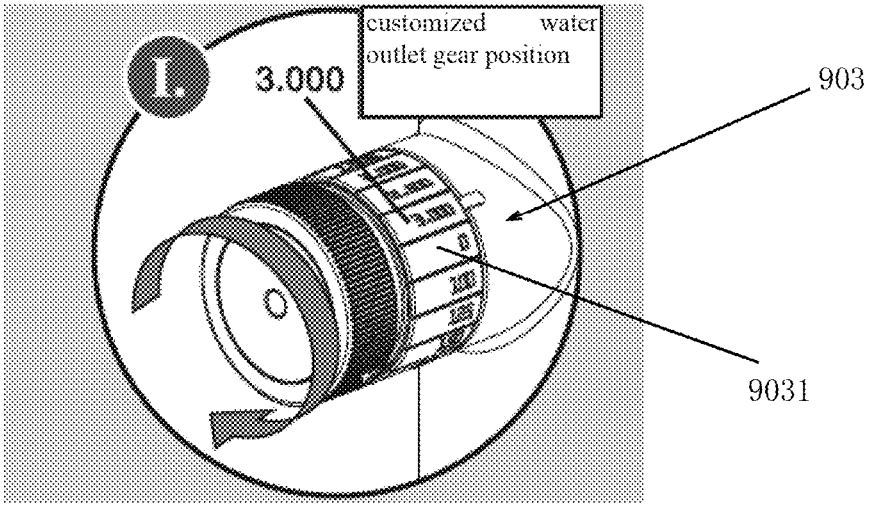
FIG. 4 illustrates a Step 2 of the customized water outlet setting method of the present disclosure, wherein (a) represents an operation step and (b) represents an operation result.
Figure 4:
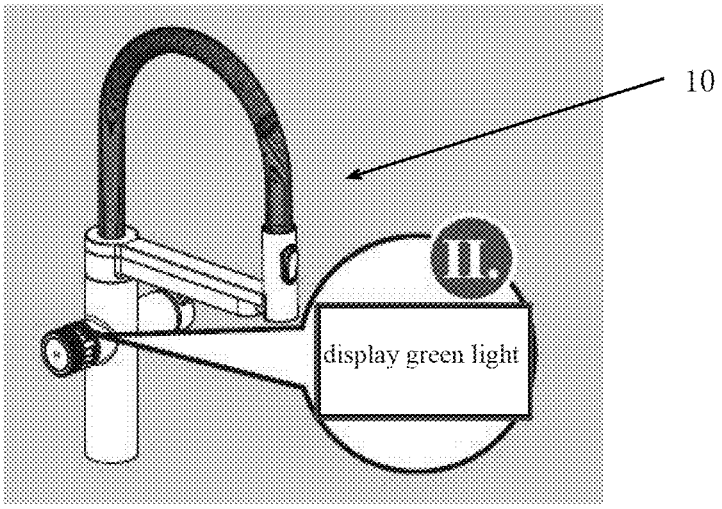
Figure 5:
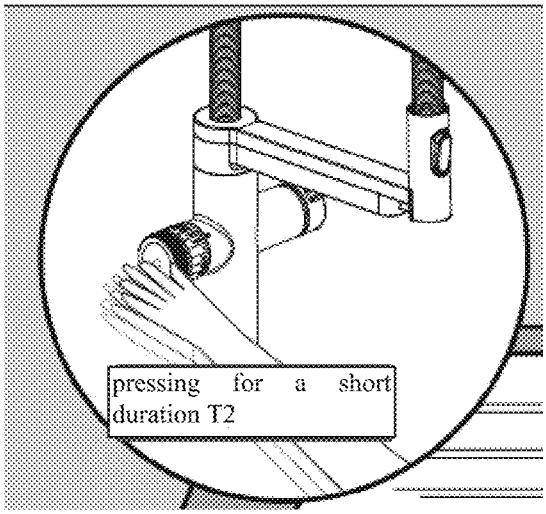
FIG. 5 illustrates a Step 3 of the customized water outlet setting method of the present disclosure, wherein (a) represents an operation step and (b) represents an operation result.
Figure 5:
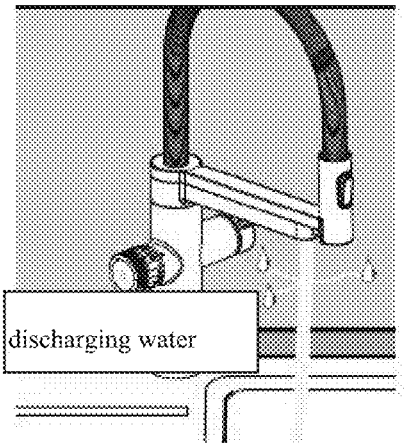
Figure 6:
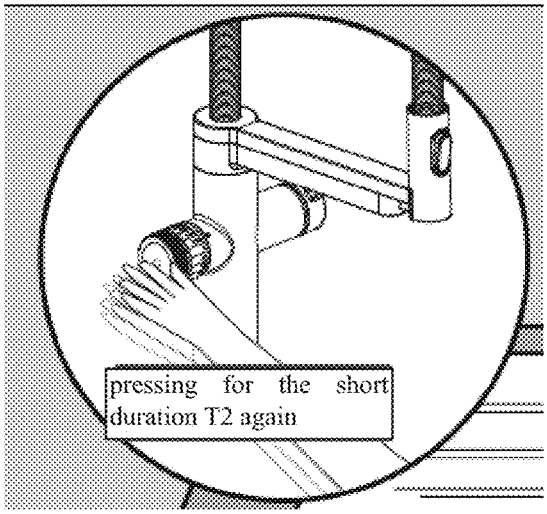
FIG. 6 illustrates a Step 4 of the customized water outlet setting method of the present disclosure, wherein (a) represents an operation step and (b) represents an operation result.
Figure 6:
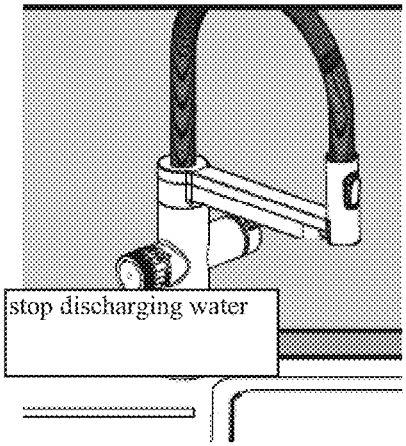
Figure 7:
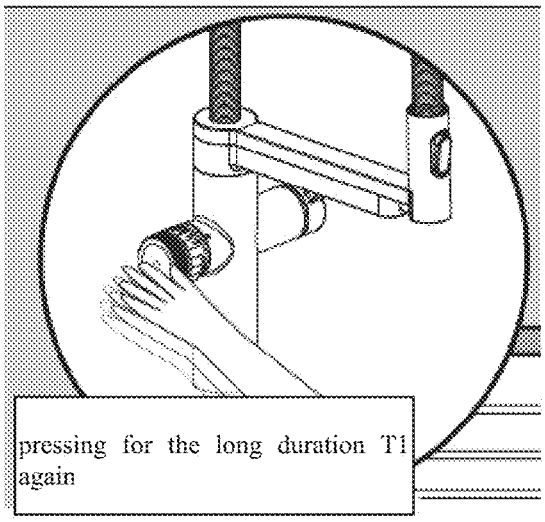
FIG. 7 illustrates a Step 5 of the customized water outlet setting method of the present disclosure, wherein (a) represents an operation step and (b) represents an operation result.
Figure 7:
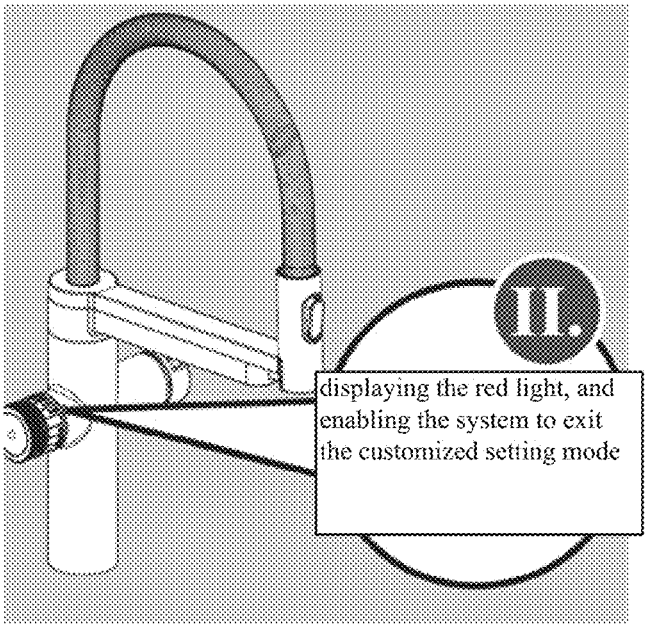

Referring to FIG. 2, in another embodiment, before setting the capacity obtained by the flowmeter as the water outlet capacity corresponding to the customized water outlet gear position, the customized water outlet setting method further comprises:

S109: receiving the first touch/press signal of the water outlet setting switch again.

Referring to FIG. 1, the customized water outlet setting method of the present disclosure can exit the customized setting mode after receiving the second touch/press signal of the water outlet control switch again and controlling the water outlet valve to be closed, thereby simplifying operation steps. In order to prevent a false reset, the customized setting mode can be exited after receiving the first touch/press signal of the water outlet setting switch again.

Specifically, the flow selection switch comprises a quantitative ring 9031 disposed on one side of a water outlet end of the quantitative faucet 10. The quantitative ring 9031 comprises a flow graduated scale, and each scale on the flow graduated scale corresponds to one quantitative gear position. The water outlet end of the quantitative faucet 10 is disposed with an indicator.

When the customized setting mode is not entered and the quantitative ring 9031 is rotated to enable one scale on the flow graduated scale to be aligned with the indicator, a currently selected water outlet capacity can be represented. For example, the quantitative ring 9031 is rotated to enable a scale "3" on the flow graduated scale to be aligned with the indicator, and the currently selected water outlet capacity "3 L" can be represented. In this embodiment, after entering the customized setting mode by touching/pressing the water outlet setting switch, the quantitative ring 9031 is first rotated to align a scale "2" on the flow graduated scale with the indicator, and then the water outlet valve is controlled to be opened. When a current water outlet capacity corresponding to a current quantitative gear position of the scale "2" is set to be a cup of water (e.g., 3.3 L) of a cup used at home, the cup is used to receive water. When the cup is full of water, the water outlet valve is controlled to be closed, and then the water outlet setting switch is touched/pressed to execute a confirmation action and automatically exit the customized setting mode. After that, when the quantitative ring 9031 is rotated to make the scale "2" on the flow graduated scale align with the indicator, after the water outlet valve is opened, when the water outlet capacity reaches 3.3 L, the water outlet valve is automatically closed. By the customized water outlet setting method of the embodiment, the water outlet capacity corresponding to the customized water outlet gear position can be reset, and the personalized requirements of consumers are met.

In one embodiment, the water outlet setting switch and the water outlet control switch are independently arranged. That is, the water outlet setting switch and the water outlet control switch are arranged at different positions of the quantitative faucet 10 and are separately controlled. When the water outlet setting switch and the water outlet control switch are independently arranged, a touch/press time does not need to be considered, and a control instruction is triggered as long as a touch/press action is generated on the water outlet setting switch or the water outlet control switch.

It should be noted that although the steps of this embodiment are "receiving the first touch/press signal of the water outlet setting switch, and entering the customized setting mode" and then "receiving the quantitative gear position setting signal of the flow selection switch", in practical implementation, the steps can also be "receiving the quantitative gear position setting signal of the flow selection switch" firstly and then "receiving the first touch/press signal of the water outlet setting switch, and entering the customized setting mode". The embodiment is not particularly limited.

In another embodiment, in order to save cost and simplify the process, the water outlet setting switch and the water outlet control switch can be a same switch, and the processor distinguishes whether a switch is used as the water outlet setting switch or the water outlet control switch through different touch/press durations, and a specific method is as follows.

Before entering the customized setting mode, the customized water outlet setting method further comprises:

judging a duration of receiving the first touch/press signal of the water outlet setting switch, when the duration is greater than or equal to a first duration, entering the customized setting mode;

before controlling the water outlet valve to be opened, further comprising:

judging a duration of receiving the second touch/press signal of the water outlet control switch, when the duration is less than a second duration, controlling the water outlet valve to be opened;

before controlling the water outlet valve to be closed, further comprising:

judging the duration of receiving the second touch/press signal of the water outlet control switch, when the duration is less than the second duration, controlling the water outlet valve to be closed; and before exiting the customized setting mode, the customized water outlet setting method further comprises:

judging the duration of receiving the first touch/press signal of the water outlet setting switch, when the duration is greater than or equal to the first duration, exiting the customized setting mode.

The first duration is greater than or equal to the second duration. That is, the switch being touched or pressed for a long duration is used as the water outlet setting switch, and the switch being touched or pressed for a short duration, which is shorter than the long duration, is used as the water outlet control switch.

In other embodiments, the switch being touched or pressed for a long duration can be used as the water outlet control switch, the switch being touched or pressed for a short duration can be used as the water outlet setting switch, and a specific method is as follows.

Before entering the customized setting mode, the customized water outlet setting method further comprises:

judging the duration of receiving the first touch/press signal of the water outlet setting switch, when the duration is less than the second duration, entering the customized setting mode;

before controlling the water outlet valve to be opened, further comprising:

judging the duration of receiving the second touch/press signal of the water outlet control switch, when the duration is greater than or equal to the first duration, controlling the water outlet valve to be opened;

before controlling the water outlet valve to be closed, further comprising:

judging the duration of receiving the second touch/press signal of the water outlet control switch, when the duration is greater than or equal to the first duration, controlling the water outlet valve to be closed; and before exiting the customized setting mode, the customized water outlet setting method further comprises:

judging the duration of receiving the first touch/press signal of the water outlet setting switch, when the duration is less than the second duration, exiting the customized setting mode.

The first duration is greater than or equal to the second duration. That is, the switch being touched or pressed for a long duration can be used as the water outlet control switch, and the switch being touched or pressed for a short duration can be used as the water outlet setting switch.

In this embodiment, after receiving the first touch/press signal of the water outlet setting switch, the customized water outlet setting method further comprises:

controlling a customized indicator lamp to display a first color;

after receiving the quantitative gear position setting signal of the flow selection switch, further comprising:

controlling the customized indicator lamp to display a second color; and after receiving the first touch/press signal of the water outlet setting switch again, the method further comprises:

controlling the customized indicator lamp to display a third color.

Specifically, the first color, the second color, and the third color are different, or the first color and the third color are the same, and the second color is different.

Referring to FIGS. 3 to 7, a customized water outlet setting using a method according to an embodiment of the present disclosure comprises:

Step 1: pressing the water outlet setting switch for a long duration T1 (i.e., the first duration), displaying a red light by the customized indicator lamp, and enabling a system to enter the customized setting mode;

Step 2: rotating the quantitative ring 9031 to a gear position to be customized, and displaying a blue light by the customized indicator lamp;

Step 3: pressing the water outlet control switch for a short duration T2 (i.e., the second duration), and controlling to discharge water;

Step 4: when the water outlet capacity reaches a desired water capacity, pressing the water outlet control switch for the short duration T2 (i.e., the second duration), and controlling to stop discharging water; and Step 5: pressing the water outlet setting switch for a long duration T1 (i.e., the first duration), displaying the red light by the customized indicator lamp, and enabling the system to exit the customized setting mode.

Figure 8:
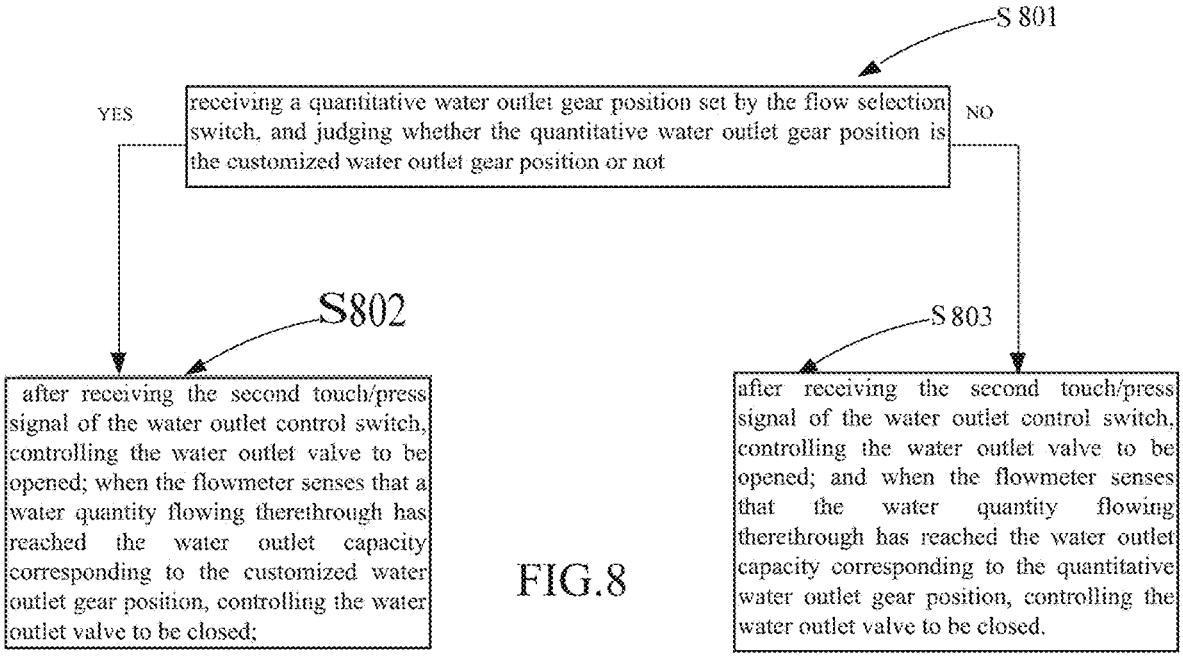
FIG. 8 illustrates a flow chart of a customized water outlet method of the present disclosure.

Referring to FIG. 8, a customized water outlet method of the quantitative faucet 10, based on the customized water outlet setting method, comprises:

S801, receiving a quantitative water outlet gear position set by the flow selection switch, and judging whether the quantitative water outlet gear position is the customized water outlet gear position or not: when the quantitative water outlet gear position is the customized water outlet gear position, going to S802; and when the quantitative water outlet gear position is not the customized water outlet gear position, going to S803;

S802, after receiving the second touch/press signal of the water outlet control switch, controlling the water outlet valve to be opened: when the flowmeter senses that a water quantity flowing therethrough has reached the water outlet capacity corresponding to the customized water outlet gear position, controlling the water outlet valve to be closed; and S803, after receiving the second touch/press signal of the water outlet control switch, controlling the water outlet valve to be opened; and when the flowmeter senses that the water quantity flowing therethrough has reached the water outlet capacity corresponding to the quantitative water outlet gear position, controlling the water outlet valve to be closed.

Figure 9:
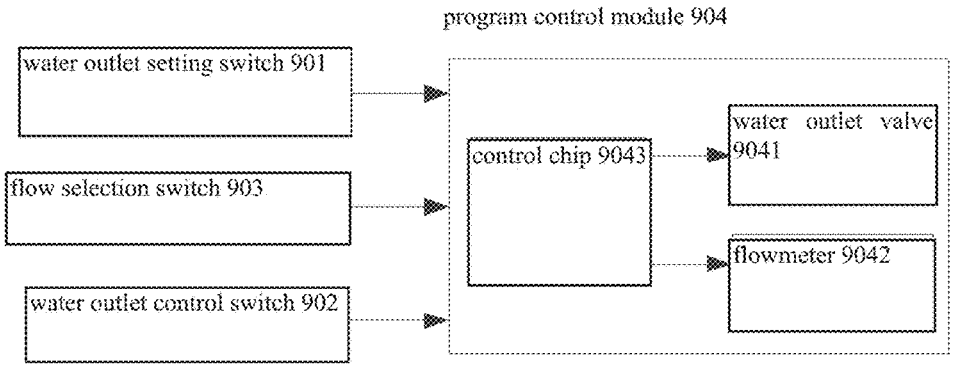
FIG. 9 is a block diagram of the quantitative faucet of the present disclosure.

Referring to FIG. 9, the quantitative faucet 10 comprises the water outlet setting switch 901, the water outlet control switch 902, a flow selection switch 903, and a program control module 904.

The flow selection switch 903 comprises the quantitative ring 9031, and the quantitative ring 9031 comprises a plurality of the quantitative water outlet gear positions. Each quantitative water outlet gear position is correspondingly disposed with an induction magnet.

The program control module 904 comprises the water outlet valve 9041, the flowmeter 9042, and the control chip 9043. The induction magnet is magnetically connected with a hall sensor on the control chip 9043.

The control chip 9043 is connected with the water outlet setting switch 901 to receive the first touch/press signal of the water outlet setting switch 901 so as to enter the customized setting mode, so that a quantitative water outlet gear position selected by the flow selection switch 903 is set as the customized water outlet gear position, and the water outlet capacity corresponding to the quantitative water outlet gear position is modified into a customized water outlet capacity.

The water outlet control switch 902 is connected with the control chip 9043, and after the flow selection switch 903 is used for selecting the customized water outlet gear position, the control chip 9043 controls the water outlet valve 9041 to be opened after receiving the second touch/press signal of the water outlet control switch 902; when the flowmeter 9042 senses that the quantity of water flowing therethrough has reached the water outlet capacity corresponding to the customized water outlet gear position, the control chip 9043 controls the water outlet valve 9041 to be closed. In this embodiment, the water outlet setting switch 901 and the water outlet control switch 902 are independently set: alternatively, the water outlet setting switch 901 and the water outlet control switch 902 are set as the same switch.

Specifically, the water outlet setting switch 901 and the water outlet control switch 902 are touch sensitive switches or mechanical switches. When the water outlet setting switch 901 and the water outlet control switch 902 are touch sensitive switches, the touch sensitive switches can be infrared touch switches or capacitive touch switches, and the like. The touch sensitive switches can be touched to generate trigger signals. In the case of mechanical switches, the trigger signals are activated by pressing.

It should be noted that one or more of the customized water outlet gear positions can be set as required, and each of the customized water outlet gear positions corresponds to a customized water outlet capacity. When the quantitative faucet 10 is used subsequently, the control chip can control the water outlet valve to output a corresponding customized water outlet capacity according to one of the customized water outlet gear positions selected by the flow selection switch.

In this embodiment, the quantitative faucet 10 comprises a faucet or a shower head. The customized water outlet setting method and the customized water outlet method refer to the implementation described above, and the embodiment is not described repeatedly.

The present application describes embodiments, but the description is illustrative rather than limiting and it will be apparent to those of ordinary skill in the art that many more embodiments and implementations are possible within the scope of the embodiments described herein. Although many possible combinations of features are shown in the drawings and discussed in the detailed description, many other combinations of the disclosed features are possible. Any feature or element of any embodiment may be used in combination with or instead of any other feature or element in any other embodiment, unless expressly limited otherwise.

The present application includes and contemplates combinations of features and elements known to those of ordinary skill in the art. The embodiments, features, and elements disclosed in this application may also be combined with any conventional features or elements to form a unique inventive concept as defined by the claims. Any feature or element of any embodiment may also be combined with features or elements from other inventive aspects to form yet another unique inventive aspect, as defined by the claims. Thus, it should be understood that any of the features shown and/or discussed in this application may be implemented alone or in any suitable combination. Accordingly, the embodiments are not limited except as by the appended claims and their equivalents. Furthermore, various modifications and changes may be made within the scope of the appended claims.

Further, in describing representative embodiments, the specification may have presented the method and/or process as a particular sequence of steps. However, to the extent that the method or process does not rely on the particular order of steps set forth herein, the method or process should not be limited to the particular sequence of steps described. Other orders of steps are possible as will be understood by those of ordinary skill in the art. Therefore, the particular order of the steps set forth in the specification should not be construed as limitations on the claims. Further, the claims directed to the method and/or process should not be limited to the performance of their steps in the order written, and one skilled in the art can readily appreciate that the sequences may be varied and still remain within the spirit and scope of the embodiments of the present application.

What is claimed is:

1. A customized water outlet setting method for a quantitative faucet, the customized water outlet setting method comprising the steps of:

receiving a first touch/press signal of a water outlet setting switch, and entering a customized setting mode;

receiving a quantitative gear position setting signal of a flow selection switch, and obtaining a corresponding quantitative gear position as a customized water outlet gear position;

receiving a second touch/press signal of a water outlet control switch, controlling a water outlet valve to be opened, and controlling a flowmeter to start flow counting;

after receiving the second touch/press signal of the water outlet control switch again, controlling the water outlet valve to be closed, and controlling the flowmeter to end the flow counting;

setting a capacity obtained by the flowmeter as a water outlet capacity corresponding to the customized water outlet gear position; and exiting the customized setting mode.

2. The customized water outlet setting method for the quantitative faucet according to claim 1, wherein:

the water outlet setting switch and the water outlet control switch are independently arranged.

3. The customized water outlet setting method for the quantitative faucet according to claim 1, wherein:

the water outlet setting switch and the water outlet control switch are a same switch;

before entering the customized setting mode, the customized water outlet setting method further comprises the step of:

judging a duration of receiving the first touch/press signal of the water outlet setting switch, and when the duration of receiving the first touch/press signal of the water outlet setting switch is greater than or equal to a first duration, entering the customized setting mode;

before controlling the water outlet valve to be opened, the customized water outlet setting method further comprises the step of:

judging a duration of receiving the second touch/press signal of the water outlet control switch, and when the duration of receiving the second touch/press signal of the water outlet control switch is less than a second duration, controlling the water outlet valve to be opened;

before controlling the water outlet valve to be closed, the customized water outlet setting method further comprises the step of:

judging the duration of receiving the second touch/press signal of the water outlet control switch for a second time, and when the duration of receiving the second touch/press signal of the water outlet control switch for the second time is less than the second duration, controlling the water outlet valve to be closed; and the first duration is greater than or equal to the second duration.

4. The customized water outlet setting method for the quantitative faucet according to claim 1, wherein:

before setting the capacity obtained by the flowmeter as the water outlet capacity corresponding to the customized water outlet gear position, the customized water outlet setting method further comprises the step of:

receiving the first touch/press signal of the water outlet setting switch again.

5. The customized water outlet setting method for the quantitative faucet according to claim 4, wherein:

the water outlet setting switch and the water outlet control switch are a same switch;

before entering the customized setting mode, the customized water outlet setting method further comprises the step of:

judging a duration of receiving the first touch/press signal of the water outlet setting switch, and when the duration of receiving the first touch/press signal of the water outlet setting switch is greater than or equal to a first duration, entering the customized setting mode;

before controlling the water outlet valve to be opened, the customized water outlet setting method further comprises the step of:

judging a duration of receiving the second touch/press signal of the water outlet control switch, and when the duration of receiving the second touch/press signal of the water outlet control switch is less than a second duration, controlling the water outlet valve to be opened;

before controlling the water outlet valve to be closed, the customized water outlet setting method further comprises the step of:

judging the duration of receiving the second touch/press signal of the water outlet control switch for a second time, and when the duration of receiving the second touch/press signal of the water outlet control switch for the second time is less than the second duration, controlling the water outlet valve to be closed;

before exiting the customized setting mode, the customized water outlet setting method further comprises the step of:

judging the duration of receiving the first touch/press signal of the water outlet setting switch for a second time, and when the duration of receiving the first touch/press signal of the water outlet setting switch for the second time is greater than or equal to the first duration, exiting the customized setting mode; and the first duration is greater than or equal to the second duration.

6. The customized water outlet setting method for the quantitative faucet according to claim 1, wherein:

after receiving the first touch/press signal of the water outlet setting switch, the customized water outlet setting method further comprises the step of:

controlling a customized indicator lamp to display a first color;

after receiving the quantitative gear position setting signal of the flow selection switch, the customized water outlet setting method further comprises the step of:

controlling the customized indicator lamp to display a second color; and after receiving the first touch/press signal of the water outlet setting switch again, the customized water outlet setting method further comprises the step of:

controlling the customized indicator lamp to display a third color.

7. The customized water outlet setting method for the quantitative faucet according to claim 4, wherein:

after receiving the first touch/press signal of the water outlet setting switch, the customized water outlet setting method further comprises the step of:

controlling a customized indicator lamp to display a first color;

after receiving the quantitative gear position setting signal of the flow selection switch, the customized water outlet setting method further comprises the step of:

controlling the customized indicator lamp to display a second color; and after receiving the first touch/press signal of the water outlet setting switch again, the customized water outlet setting method further comprises the step of:

controlling the customized indicator lamp to display a third color.

8. The customized water outlet setting method for the quantitative faucet according to claim 6, wherein:

at least one of the first color, the second color, or the third color is different from the others of the first color, the second color, and the third color.

9. The customized water outlet setting method for the quantitative faucet according to claim 7, wherein:

at least one of the first color, the second color, or the third color is different from the others of the first color, the second color, and the third color.

10. A customized water outlet method of the quantitative faucet, based on the customized water outlet setting method according to claim 1, the customized water outlet method comprising the steps of:

receiving a quantitative water outlet gear position set by the flow selection switch, and judging whether the quantitative water outlet gear position is the customized water outlet gear position or not;

when the quantitative water outlet gear position is the customized water outlet gear position, after receiving the second touch/press signal of the water outlet control switch, controlling the water outlet valve to be opened; and when the flowmeter senses that a water quantity flowing therethrough has reached the water outlet capacity corresponding to the customized water outlet gear position, controlling the water outlet valve to be closed.

11. A quantitative faucet, comprising:

a water outlet setting switch, a water outlet control switch, a flow selection switch, and a program control module, wherein:

the flow selection switch comprises a quantitative ring, the quantitative ring comprises a plurality of quantitative water outlet gear positions, the program control module comprises a water outlet valve, a flowmeter, and a control chip, the control chip is connected with the water outlet setting switch to receive a first touch/press signal of the water outlet setting switch so as to enter a customized setting mode, so that one of the plurality of quantitative water outlet gear positions selected by the flow selection switch is configured to be set as a customized water outlet gear position and a water outlet capacity corresponding to the one of the plurality of quantitative water outlet gear positions is configured to be modified into a customized water outlet capacity, the water outlet control switch is connected with the control chip, and after the flow selection switch is configured to select the customized water outlet gear position, the control chip is configured to control the water outlet valve to be opened after receiving a second touch/press signal of the water outlet control switch, so that when the flowmeter senses that a quantity of water flowing therethrough has reached the customized water outlet capacity corresponding to the customized water outlet gear position, the control chip is configured to control the water outlet valve to be closed.

12. The quantitative faucet according to claim 11, wherein:

the water outlet setting switch and the water outlet control switch are independently arranged, or the water outlet setting switch and the water outlet control switch are a same switch.

13. The quantitative faucet according to claim 11, wherein:

the water outlet setting switch and the water outlet control switch are touch sensitive switches or mechanical switches.

14. The quantitative faucet according to claim 11, wherein:

the quantitative faucet comprises a faucet or a shower head.

* * * * *